US005243357A

United States Patent [19]

Koike et al.

[11] Patent Number: 5,243,357

[45] Date of Patent: Sep. 7, 1993

[54] WAVEGUIDE FEEDING ARRAY ANTENNA

[75] Inventors: Hiroshi Koike; Toshio Abiko; Yasuhiro Fujii; Hiroo Inoue; Katsuya Tsukamoto, all of Kadoma, Japan

[73] Assignee: Matsushita Electric Works, Ltd., Osaka, Japan

[21] Appl. No.: 612,577

[22] Filed: Nov. 14, 1990

[30] Foreign Application Priority Data

Nov. 27, 1989 [JP] Japan ..... 1-308812
Nov. 27, 1989 [JP] Japan ..... 1-308813

[51] Int. Cl.[5] ..... H01Q 13/00

[52] U.S. Cl. ..... 343/776; 343/778; 343/779; 343/872

[58] Field of Search ..... 343/776, 772, 780, 781 R, 343/781 P, 784, 775, 778, 779, 909, 872, 786

[56] References Cited

U.S. PATENT DOCUMENTS

| | | | |
|---|---|---|---|
| 2,398,095 | 4/1946 | Katzin | 343/786 |
| 2,623,993 | 12/1952 | Altar | 343/776 |
| 2,972,148 | 2/1961 | Rupp et al. | 343/776 |
| 3,495,262 | 2/1970 | Paine | 343/776 |
| 3,774,223 | 11/1973 | Ehrenspeck et al. | 343/779 |
| 4,096,482 | 6/1978 | Walters | 343/776 |
| 4,581,615 | 4/1986 | Levy | 343/872 |
| 4,743,915 | 5/1988 | Rammos et al. | 343/776 |
| 4,795,993 | 1/1989 | Park et al. | 333/33 |

*Primary Examiner*—Donald T. Hajec
*Assistant Examiner*—Hoanganh Le
*Attorney, Agent, or Firm*—Leydig, Voit & Mayer

[57] ABSTRACT

A waveguide feeding array antenna is provided to be capable of separating and taking up each of the polarization components of the horizontal and vertical polarized waves received concurrently at an opening of each of a plurality of waveguides arranged to form a network, by means of a taking-up equipment disposed in the waveguide circuit. The both polarization components can be made thereby to be effectively separated from and composed with each other while realizing the simplification and economization of the waveguide network.

19 Claims, 9 Drawing Sheets

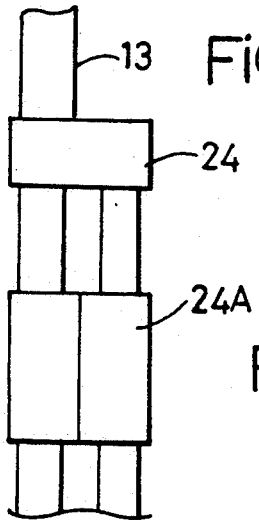
Fig.13
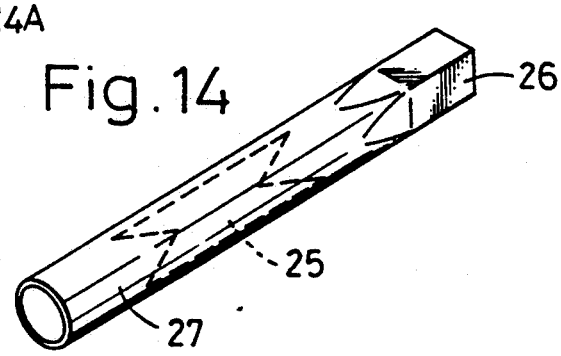
Fig.14
Fig.16
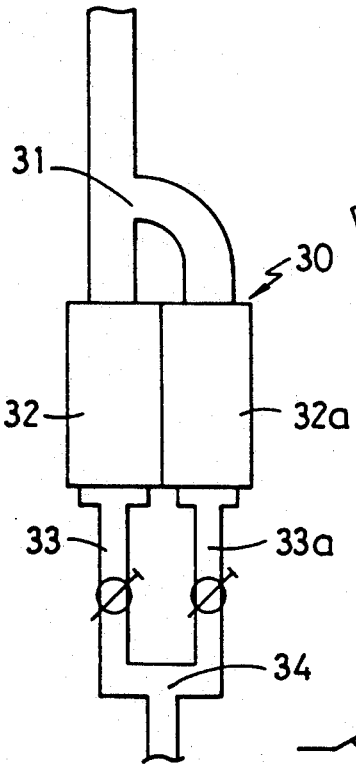
Fig.15
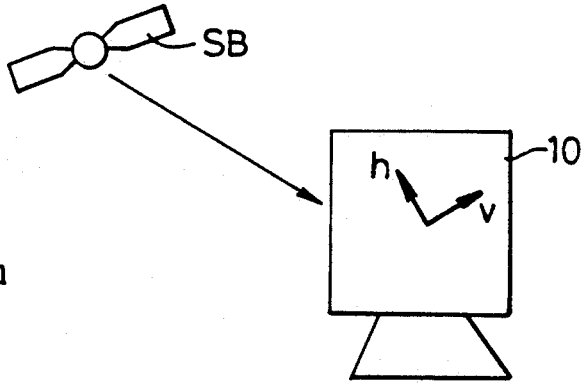
Fig.17
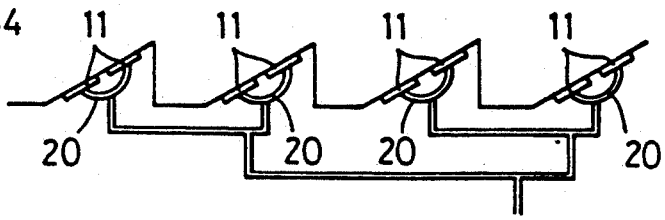

Fig. 22
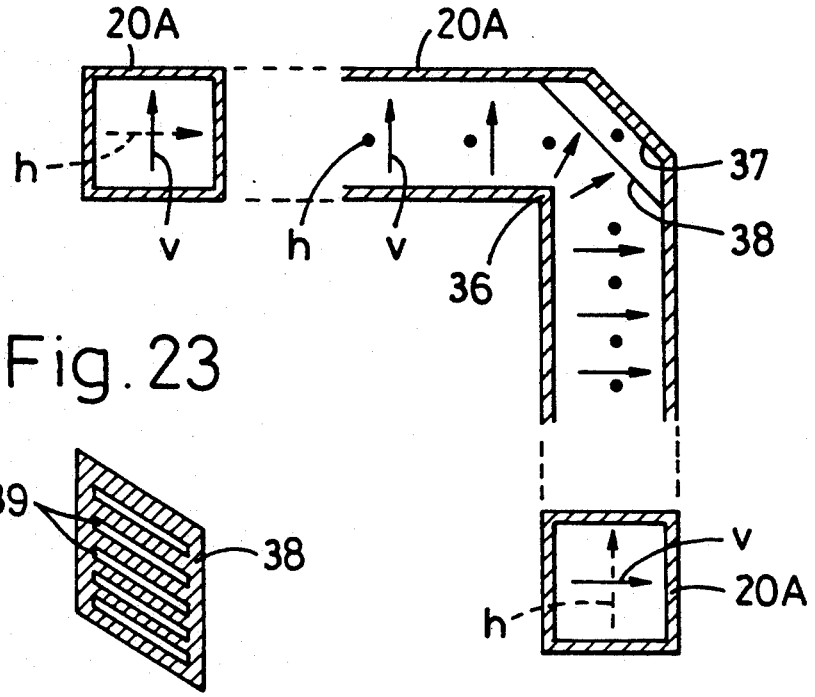
Fig. 23
Fig. 24
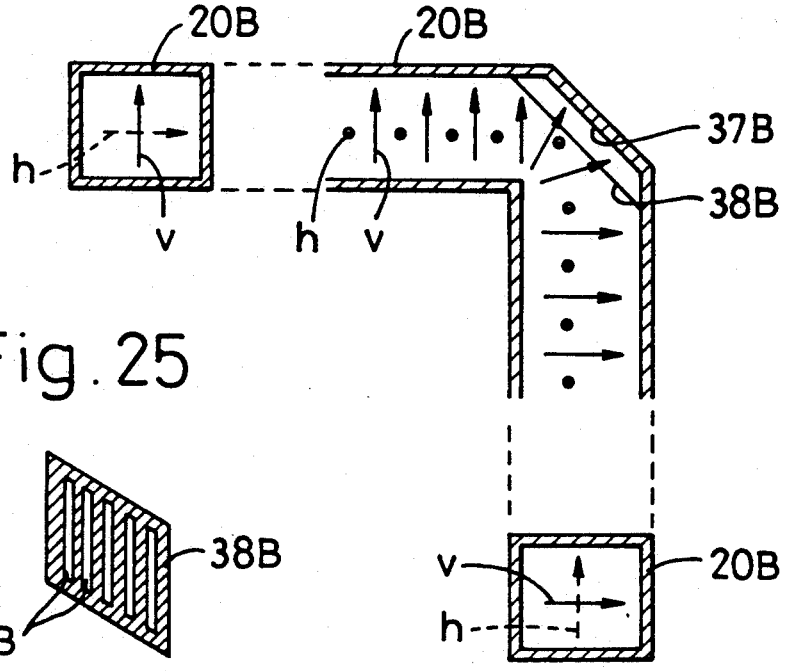
Fig. 25
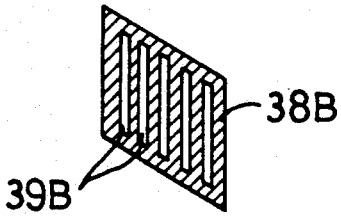

WAVEGUIDE FEEDING ARRAY ANTENNA

BACKGROUND OF THE INVENTION

This invention relates to a waveguide feeding array antenna and, more particularly, to the waveguide feeding array antenna which can reduce the loss at the feeding system so as to allow microwaves received at a high gain over a wide band range.

The waveguide feeding array antenna of the kind referred to can be effectively utilized in receiving concurrently such microwaves as horizontal and vertical polarized waves which are transmitted from a geostationary broadcasting satellite launched into cosmic space to be 36,000 Km from the earth, as carried on SHF band.

DESCRIPTION OF RELATED ART

Generally, parabolic antennas normally erected on roofs of house buildings and the like position have been widely utilized in receiving the radio waves transmitted from the geostationary broadcasting satellite. These parabolic antennas have been defective in that they are susceptible to strong winds and may easily fall down due to the antenna's bulky three dimensional structure. A means for stably supporting the antennas' needs to be employed requiring higher costs and added labor for installation.

In an attempt to eliminate these problems in the parabolic antennas, there have been suggested various types of planar antennas which are flattened in the entire configuration by arranging many microstrip conductor lines on a plane surface, as disclosed in, for example, U.S. Pat. No. 4,475,107. This allows the antenna structure to be simplified and to be inexpensively mounted directly on an outdoor wall or other similar locations. In the planar antennas, however, the loss at the feed system has been generally remarkable as (1.5 to 3.0 dB/M), increasing thermal noise. This loss has been a problem particularly when a large size planar antenna is used.

An antenna which can reduce this loss has been disclosed in, for example, U.S. Pat. No. 3,774,223 to Hermann W. Ehrenspeck et al. In which, a waveguide is coupled to a main reflector plate and a subsidiary reflector plate is disposed in front of the waveguide. In U.S. Pat. No. 4,743,915 to Emmanuel Rammos et al., there is disclosed a high frequency antenna in which a pair of waveguides are arranged to have four end openings disposed on a common plane while the waveguides are coupled through a T-shaped waveguide. U.S. Pat. No. 4,795,993 to Pyong K. Park et al., shows a waveguide corner arrangement which is utilized in the waveguide antenna. This arrangement includes a wedge-shaped reflector having multiple reflecting surfaces made by mutually parallel ridges provided on an outer side of each corner in the waveguide. This enables two polarizations mutually intersecting at right angles to be converted and propagated simultaneously. The antennas based on these disclosures will have a relatively small loss at the feed system and may be usefully employed in large size antennas.

Known arrangements according to the prior art are insufficient for taking up the respective polarization components separately from each other with a waveguide which simultaneously receives the horizontal and the vertical polarized waves. It is preferable that such separation is effectively realized while simplifying the waveguide structure. It will be possible to provide a remarkably economized waveguide feeding array antenna once the waveguide structure can be simplified.

SUMMARY OF THE INVENTION

A primary object of the present invention is to provide a waveguide feeding array antenna which makes it possible to take up the respective polarization components with a simple waveguiding structure in waveguide for receiving the horizontal and vertical polarized waves simultaneously.

According to the present invention, this object can be attained by a waveguide feeding array antenna which comprises a plurality of waveguides forming a waveguide network, said waveguides having openings arranged in an array for receiving both horizontal and vertical polarized waves simultaneously, and said waveguide network being provided for separation from each other and composition with each other of both waves, and wherein means is provided in said waveguide network for feeding respective polarization components of both polarized waves independently of each other.

Other objects and advantages of the present invention shall be made clear in the detailed description which follows. Reference will be made to each of the embodiments shown in the drawings.

BRIEF EXPLANATION OF THE DRAWINGS

FIG. 13 is a schematic explanatory view for a converting means for circular polarized waves which is applied to the antenna of FIG. 1;

FIG. 14 shows in a schematic perspective view another aspect of the converting means of the circular polarized waves;

FIG. 15 is an explanatory view for a polarization control employed in the antenna of FIG. 1;

FIG. 16 is an explanatory view for a polarization angle control employed in the antenna of FIG. 1;

FIG. 17 is an explanatory view for a tilt mode employed in the antenna of FIG. 1;

FIG. 22 is an explanatory view for another working example of the waveguide employed in the antenna of FIG. 1;

FIG. 23 is an explanatory view for a conductor plate employed in the waveguide of FIG. 22;

FIG. 24 is an explanatory view for still another working example of the waveguide employed in the antenna of FIG. 1;

FIG. 25 is an explanatory view for a conductor plate included in the waveguide of FIG. 24;

Figure 1:
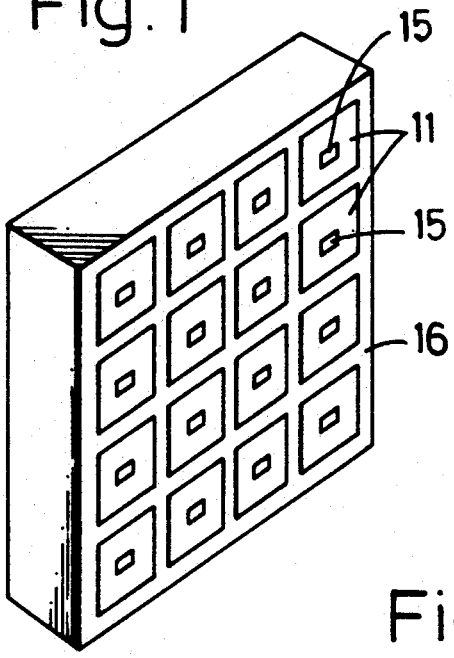
FIG. 1 is a schematic perspective view showing an embodiment of the waveguide feeding array antenna according to the present invention.

While the present invention shall now be explained with reference to the respective embodiments and examples shown in the drawings, it should be appreciated that the intention is not to limit the invention only to those embodiments shown but rather to include all alterations, modifications and equivalent arrangements possible within the scope of appended claims.

DETAILED DESCRIPTION OF THE PREFERRED EMBODIMENTS

Figure 2:
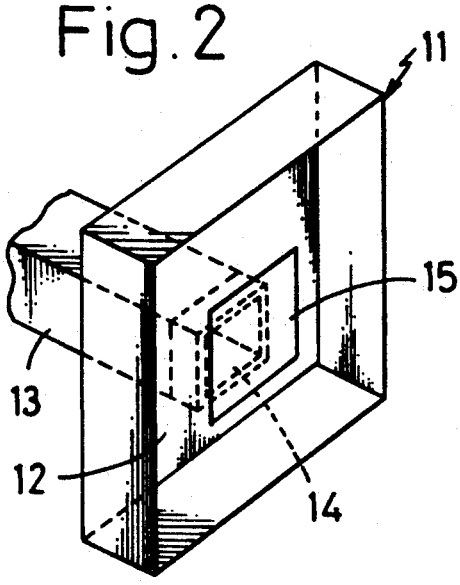
FIG. 2 is a fragmentary perspective view as magnified of an antenna element in the antenna of FIG. 1.
Figure 3:
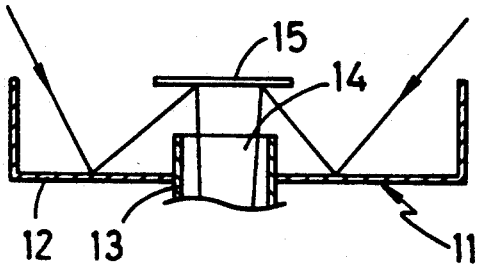
FIG. 3 is a schematic sectioned view of the antenna element of FIG. 2.

Referring to FIG. 1, there is shown a waveguide feeding array antenna 10 according to the present invention, in which a plurality of antenna elements 11 are arranged in horizontal and vertical arrays, so as to form a short backfire antenna as a whole. The antenna elements 11 respectively comprise, as shown in FIGS. 2 and 3, a main reflector plate 12 of a shallow, flat box shape opened on front side, a waveguide 13 coupled at an end opening 14 to an aperture made in the center of the main reflector plate 12, and a subsidiary reflector plate 15 of a much smaller size than the main reflector plate 12 but slightly larger than the opening 14 and disposed to be kept slightly spaced from the opening 14 as mounted conveniently to the main reflector plate 12 through a proper holding means (not shown here). In the illustrated embodiment, 16 pieces, for example, of the antenna elements 11 in arrays of 4×4. In this case, a shallow, flat box-shaped body of the antenna 10 may be formed by a synthetic resin, with recesses of 4×4 defined in this body, and the main reflector plates 12 of the respective antenna elements 11 may be formed by providing a metal plating to inner wall surfaces of the respective recesses. It will be also possible to cover front side of the body on which the open side of the respective main reflector plates 12 are disposed, with a radome 16 allowing the microwaves to pass therethrough, and to provide the subsidiary reflector plates 15 by means of a metal plating made onto the radome 16.

Figure 4:
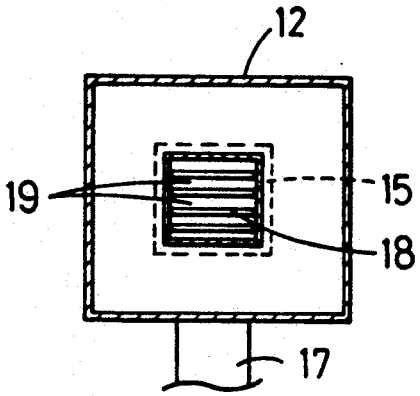
FIG. 4 shows in a vertically sectioned view taken between main and subsidiary reflector plates of a practical working example of the antenna element of FIG. 2.
Figure 5:
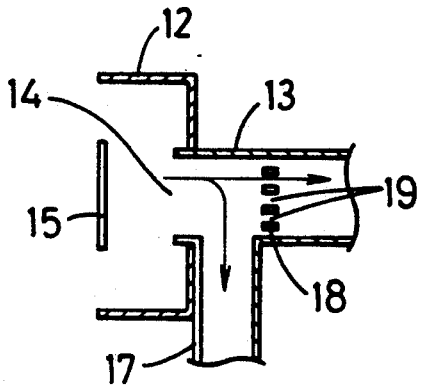
FIG. 5 is a vertically sectioned view taken along axial line of the example of the antenna element of FIG. 4.

Further, it is preferable to connect to the waveguide 13 at its portion, for example, immediately behind the opening 14 a shunt waveguide 17, and to provide in the waveguide 13 a polarization filter 18 to be disposed immediately downstream of the connecting portion of the shunt waveguide 17 (see FIGS. 4 and 5). In the present instance, the polarization filter 18 is formed to have a plurality of slits 19 mutually parallel in a horizontal direction so that, among such mutually perpendicular polarized waves as on horizontal and vertical polarized waves which are received at the opening 14, the one having the electric field perpendicular to the slits 19 will be allowed to pass therethrough to be propagated in downstream direction in the waveguide 13, whereas the other polarized wave not allowed to pass through the polarization filter 18 will be guided to the shunt waveguide 17. Consequently, the mutually perpendicular polarization components of the waves received at the opening 14 of each waveguide 13 are separated from each other to be individually propagated through the waveguides 13 and 17 and can be taken up effectively to be independent of each other, by means of such provision as disclosed above of the shunt waveguide 17 and filter 18. When the parallel slits 19 in the polarization filter 18 would be disposed to lie in vertical direction, then the polarized wave passed through the filter 18 and the other polarized wave guided to the shunt waveguides 17 would be reversed.

In order to receive the mutually perpendicular horizontal and vertical polarized waves simultaneously by the respective antenna elements 11 of the above arrangement, in particular, it is important that the waveguides 13 are formed substantially square in section, including the portion of the opening 14.

Figure 6:
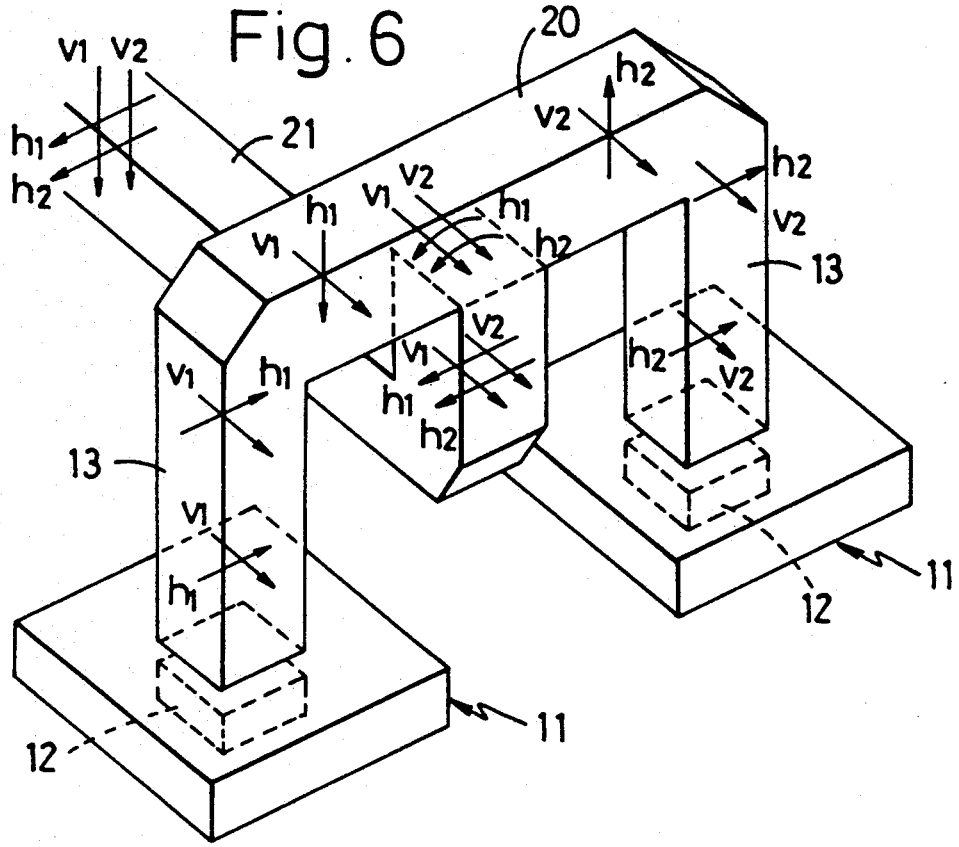
FIG. 6 is an explanatory view for a composition according to the waveguide array in FIG. 1.

Further, as shown in FIG. 6, powers of the horizontal and vertical polarized waves received from the waveguides 13 of adjacent two of the antenna elements 11 in the antenna 10 can be composed with each other through such connection waveguide 20 in in-phase relationship. In this case, too, the connection waveguide 20 is formed square in section, so that the horizontal polarized waves h1 and h2 and the vertical polarized waves v1 and v2 from the waveguides 13 will be guided through the connection waveguide 20, as effectively separated from each other. Further, the horizontal and vertical polarized waves from the both waveguides 13 are guided through L-shaped bends to the connection waveguide 20 and then, through a T-shaped branch at an intermediate portion of the connection waveguide 20, to a branch waveguide 21 so as to be taken up there, while the branch waveguide 21 is shown in FIG. 6 to be extended from the T-shaped branch through a further L-shaped bend.

Figure 7:
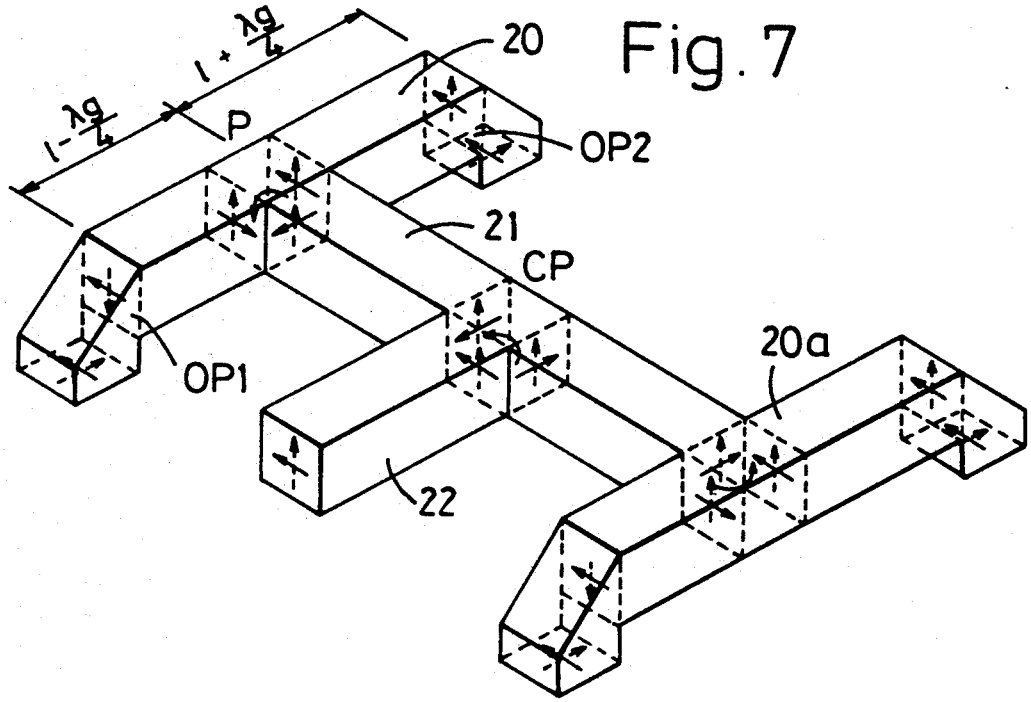
FIG. 7 is an explanatory view for the waveguide network including a composing means according to the waveguides in the antenna of FIG. 1 but in a manner different from that of FIG. 6.
Figure 8:
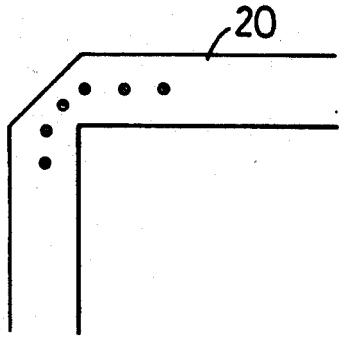
FIGS. 8 and 9 are explanatory views for the operation at L-shaped bend in the waveguide network of FIG. 7.
Figure 10:
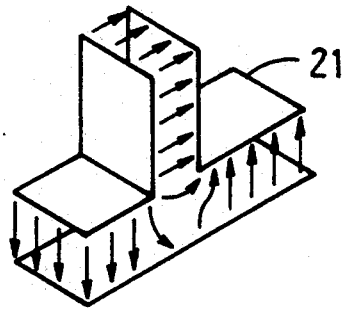
FIGS. 10 and 11 are explanatory views for the operation at T-shaped branch in the waveguide network of FIG. 7.

The foregoing arrangement of FIG. 6 is three-dimensional due to the provisions of the waveguides 13 extending from the elements and of the L-shaped bend of the connection waveguide 20, so as to render a waveguide network to be somewhat bulky when the number of the antenna elements is increased. According to another aspect of the present invention, such bulkyness is avoided in such that the connection waveguide 20 having a pair of the L-shaped bends at both ends is coupled at the T-shaped branch to the branch waveguide 21 so as to realize that, when the inter-waveguide wave length is λg, a difference of λg/2 is provided to the distances from the both waveguides 13 to the T-shaped branch of the branch waveguide 21, and thereby a waveguide network of the some function and yet attempted to be sufficiently flat is constituted. Referring to FIG. 7 in which the horizontal polarized waves are denoted by solid-line arrows while the vertical polarized waves are denoted by broken-line arrows with the reference figures omitted for brevity's sake, the respective L-shaped bends are to function at their input end as an L-shaped bend of a parallel plane with respect to the magnetic field (which plane shall be hereinafter referred to as "H-plane") for the horizontal polarized wave first, as shown in FIG. 8. Therefore, the horizontal polarized waves are caused by the L-shaped bends to change their propagating direction, and the horizontal polarized waves from the both waveguides 13 are to carry out an in-phase oscillation on opposing planes OP1 and OP2 of the pair of the L-shaped bends. Now, in the event where the horizontal polarized waves converted in a direction along a plane including the openings 14 of the both waveguides 13 are to be composed, such E-plane branch as shown in FIG. 10 is employed at the T-shaped branch to the branch waveguide 21 so as to maintain the horizontal polarized waves in the direction along the plane including the openings 14. Connection point P of the T-shaped branch to the branch waveguide 21 is displaced by λg/4 with respect to an equal distance position from the opposing planes OP1 and OP2 so that the difference λg/2 will exist in the both distances between the both planes and the connection point OP1-P and OP2-P, the respective horizontal polarized waves which have been in-phase at the opposing planes OP1 and OP2 will be in opposite phase at the connection point P and a composite horizontal polarized wave will be made to be taken up by such E-plane branch as in FIG. 10.

Figure 9:
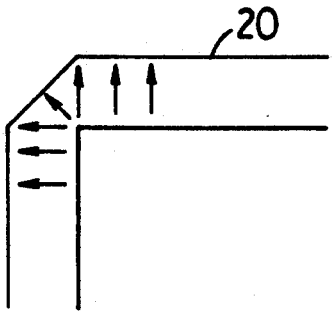
Figure 11:
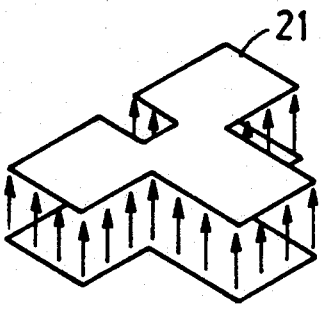

For the vertical polarized waves in FIG. 7, the input ends of the respective L-shaped bends function as an L-shaped bend of a parallel plane with the electric field ("E-plane") as shown in FIG. 9. Therefore, the vertical polarized waves are caused to change their propagating direction by the L-shaped bends and to oscillate in the opposite phase at the opposing planes OP1 and OP2 of the pair of the L-shaped bends. In the event where the vertical polarized waves which have been converted into the direction along the plane including the openings 14 of the adjacent two waveguides 13 are to be composed, such H-plane branch as shown in FIG. 11 is employed at the T-shaped branch, so as to maintain the vertical polarized waves in the direction along the plane including the openings 14. As has been described, the λg/2 difference in the distances OP1-P and OP2-P between the respective opposing planes and the connection point causes the vertical polarized waves from the both waveguides 13 in the opposite phase at the opposing planes OP1 and OP2 to become in-phase at the connection point P, and a composite vertical polarized wave is to be taken up by means of the E-plane branch of FIG. 10.

In an aspect where another connection waveguide 20a coupled to another pair of the waveguides 13 is further connected to the other end of the branch waveguide 21, as seen in FIG. 7, substantially the same function as in the foregoing connection waveguide 20 is achieved, and the composite horizontal or vertical polarized wave is to be taken up at the other end of the branch waveguide 21. Here, the composite horizontal polarized wave guided from the connection waveguide 20a is in opposite phase to such wave from the connection waveguide 20, whereas the composite vertical polarized wave is in in-phase. In composing these composite horizontal or vertical polarized waves from the both connection waveguides 20 and 20a, therefore, a further branch waveguide 22 is coupled through the T-shape branch to a central point CP of this branch waveguide 22, so that the function of the E-plane branch will be provided at the central point CP with respect to the horizontal polarized waves, or the function of the H-plane branch with respect to the vertical polarized waves, and the further composite horizontal or vertical polarized wave can be effectively taken up at the further branch waveguide 22.

Figure 12:
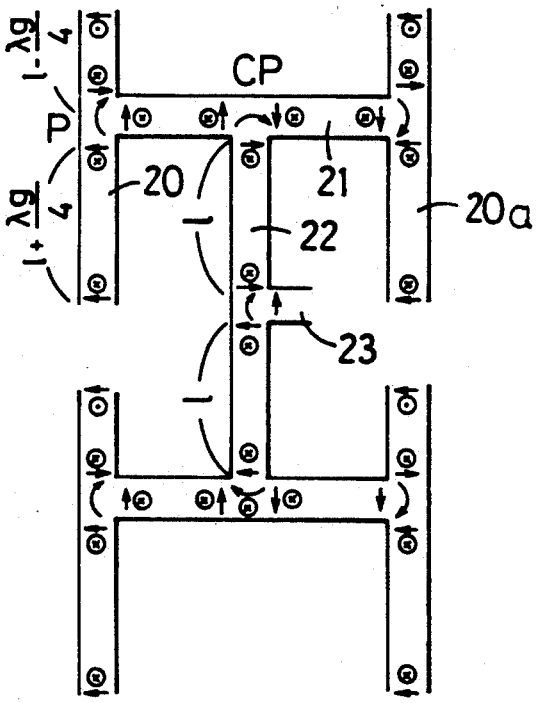
FIG. 12 is an explanatory view for another working example of the waveguide network including the composing means, in the antenna of FIG. 1.

As will be clarified when FIG. 12 is referred to, it is made possible to simultaneously compose the horizontal and vertical polarized waves received concurrently at eight of the antenna elements 11, by providing in a pair the foregoing arrangement of the pair of the connection waveguides 20 and 20a and the two stage branch waveguides 21 and 22, and coupling the both of the second stage branch waveguides 22 to each other with a third stage branch waveguides 23 through a further T-shaped branch at a center point of the waveguides 22, while separating the horizontal and vertical polarized waves from each other. Further, when two of the same paired arrangement as in FIG. 12 of the connection waveguides 20, 20a and first to third stage branch waveguides 21–23 are coupled to each other by means of a fourth stage branch waveguide through a further T-shaped branch at intermediate point of the third stage branch waveguides 23, it is possible to compose in organic manner the respective horizontal and vertical polarized waves received simultaneously at such 16 pieces of the antenna elements 11 as shown in FIG. 1. In FIG. 12, respective arrows denote the vertical polarized wave, while arrow heads and tails denote the horizontal polarized wave.

In attaining the composition of the horizontal and vertical polarized wave, it is of course possible to have the horizontal or vertical polarization components separated from the other components by means of the branch and filter arrangement shown in FIGS. 4 and 5 and thereafter to have such separated components composed individually.

It will be appreciated that the waveguide network of the foregoing arrangement is to cause the horizontal and vertical polarized waves propagated along the plane including the array of the waveguide openings, and the entire waveguide network can be readily arranged along the particular plane.

According to the present invention, the linearly polarized waves which are dual to be horizontal and vertical may be converted into a circular polarized wave by composing them with a phase difference of 90 degrees provided thereto. In this case, as shown in FIG. 13, the horizontal and vertical polarized waves are separated from each other by a separator 24 and are provided as inputs to a hybrid circuit 24A to obtain on its output side composite outputs with the 90° phase difference of the both polarized waves, as a preferable measure, and right-handed and left-handed circular polarized wave RHCP and LHCP are obtainable. On the input side of the hybrid circuit 24A, the horizontal and vertical polarized waves are not always in-phase, and a proper phase regulation is to be carried out. Further, such cylindrical waveguide 27 as shown in FIG. 14 and having therein a phase controlling plate 25 made from a dielectric member of such fluororesin as Teflon (a trademark) and at an end a converter 26 of a square section is coupled to the waveguide 13 of the foregoing antenna element 11. By axially rotating the phase controlling plate 25 inside the cylindrical waveguide 27 by means of a motor or the like (not shown), the horizontal or vertical linearly polarized wave can be properly converted into rightward or leftward swirling circular polarized wave.

In installing the waveguide feeding array antenna 10 of FIG. 1 according to the present invention, the antenna is normally held as tilted with respect to the ground surface to receive the microwave transmitted from the geostationary broadcasting satellite, but the antenna 10 may be provided to be in parallel with the ground surface as shown in FIG. 15 while adjusting the reception by carrying out a control of angle of the polarization with the mutually separated horizontal and vertical polarization components subjected to a vector composition. In the concrete, the polarization angle control can be realized by coupling such polarization angle controller 30 as shown in FIG. 16 to the waveguides 13 of the antenna 10, which controller 30 comprises a discriminator 31 for the horizontal and vertical polarized waves, hybrid circuits 32 and 32a and phase shifters 33 and **33*a* connected to the discriminator 31 for obtaining a phase difference output of 90 degrees, and a composing means 34 coupled to output ends of the phase shifters 33 and 33*a*. With this arrangement, it is possible to obtain adjusted components of the horizontal and vertical polarized waves as required, by varying the phase shifting amount at the phase shifters 33 and 33*a*. The output of the polarization angle controller 30 may be also connected, for example, to the converter 26 provided to the foregoing cylindrical waveguide 27**.

Further, it is possible to dispose the plane including the waveguide openings 14 of the respective antenna elements 11 in the antenna 10 to be at right angles with respect to a direction in which a beam tilt is made, as shown in FIG. 17, in which event the connection waveguides 20, coupled to the respective antenna elements 11 are subjected to a correction of electric length by an amount corresponding to a lag time caused to occur between the respective antenna elements 11, in carrying out the composition of the polarization components in the waveguide network.

Figure 18:
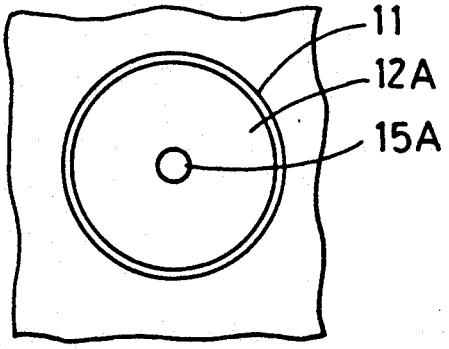
FIG. 18 shows in a front view another working example of the antenna element employed in the antenna of FIG. 1.
Figure 19:
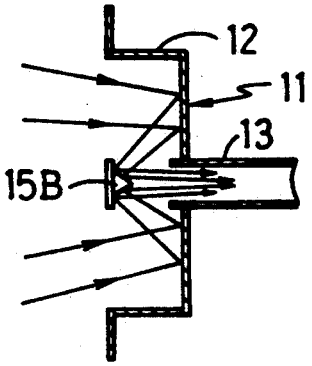
FIGS. 19-21 are schematic explanatory views for further working examples of the antenna element employable in the antenna of FIG. 1.
Figure 20:
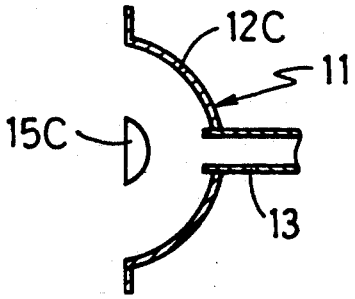
Figure 21:
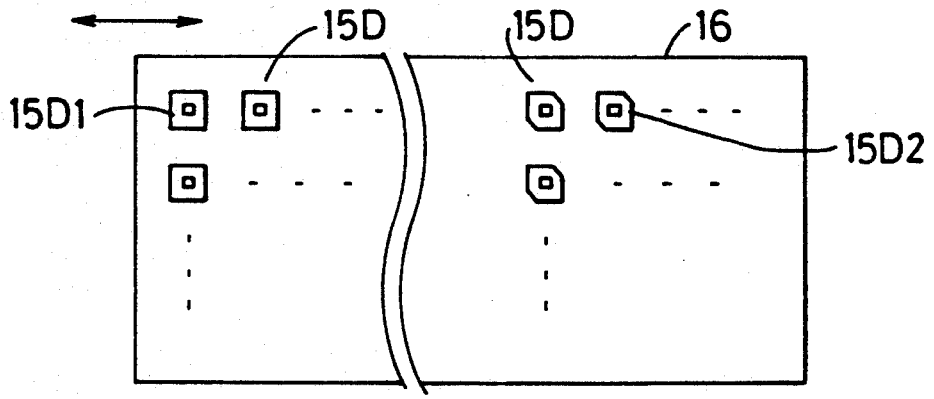

According to the present invention, the configuration of the main and subsidiary reflector plates in the antenna element should not be limited to such square shape as shown in FIGS. 1 and 2. As shown, for example, in FIG. 18, it is possible to provide the main reflector plate 12A and subsidiary reflector plate 15A to be circular. As shown further in FIG. 19, the subsidiary reflector 15B may not only be plate-shaped, but also to be in such expanding shape as a cone. As shown also in FIG. 20, the main reflector 12C may be formed in a conical or spherical shape, in combination with the subsidiary reflector 15C formed in a conical or hemispherical shape. The subsidiary reflector may also be formed by such high dielectric member as ceramics or may even be omitted in some occasion. Further, instead of the formation of the subsidiary reflector 15 by providing the metal plating to the radome 16 in FIG. 1, it is possible to provide onto the radome 16 so-called slot patches 15D arranged in a predetermined pattern, as shown in FIG. 21, so as to provide to the short backfire antenna concurrently an antenna function having the slot patch pattern. In this case, as shown also in FIG. 21, a pattern 15D1 for receiving the linearly polarized waves and a pattern 15D2 for receiving the circularly polarized waves are provided together, and such patterns are arranged for a proper change-over shift by means of such shifting means as rotating rollers or the like, so that the linearly polarized waves and circularly polarized waves can be selectively received.

According to another feature of the present invention, there can be taken a measure for restraining any differences in the cutting rate between the horizontal and vertical polarized waves in converting their direction at the E-plane and H-plane branches. Referring to FIGS. 22 and 23, a connection waveguide 20A including an L-shaped bend for propagating simultaneously the horizontal polarized wave h and vertical polarized wave v which are intersecting each other at right angles is provided at the L-shaped bend 36 with a slant 37 substantially at 45 degrees with respect to the propagating direction of the waves, and a conductor plate 38 is provided also at the bend 36 to be parallel to the slant 37 while this conductor plate 38 is formed to have a plurality of slits 39 mutually parallel and lying in a direction perpendicular to the electric field of the horizontal polarized wave h. According to this arrangement, the horizontal polarized wave h having the electric field perpendicular to the lying direction of the slits 39 is caused to pass through the conductor plate 38 whereas the vertical polarized wave v is subjected, due to its electric field of the same direction as the slits 39, to an influence of the conductor plate 38. Consequently, the cutting rate is determined by the slant 37 with respect to the horizontal polarized wave h but by the position of the conductor plate 38 parallel to the slant 37 with respect to the vertical polarized wave v. When the set positions of the slant 37 and conductor plate 38 are so made as to be suitable for the propagation of the both horizontal and vertical polarized waves and to be effective to provide to the both waves substantially the same cutting rate, the both waves can obtain excellent propagation characteristics.

On the other hand, the optimum cutting rate of the bend with respect to the horizontal polarized wave is not always larger than that with respect to the vertical polarized wave. The optimum cutting rate is to vary in accordance with the inner diameter of the L-shaped bend and the inter-waveguide wave length of the electromagnetic wave propagated therethrough. Now, in an event where the optimum cutting rate with respect to the horizontal polarized wave h is smaller than that with respect to the vertical polarized wave v in contrast to the aspect of FIGS. 22 and 23, it will be possible to attain excellent propagation characteristics for both waves similarly to the foregoing case, by providing in the conductor plate 38B which is parallel to the slant 37B a plurality of slits 39B extending in a direction parallel to the electric field of the horizontal polarized wave within the connection waveguide 20B as shown in FIGS. 24 and 25.

Figure 26:
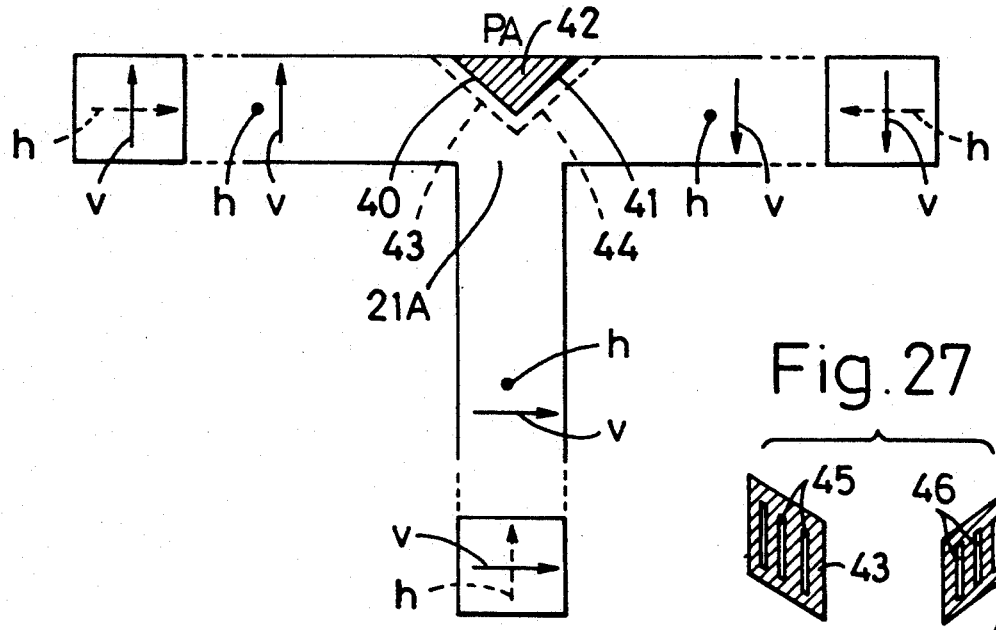
FIG. 26 is an explanatory view for a working example of the waveguide having a T-shaped branch to be employed in the antenna of FIG. 1.
Figure 27:
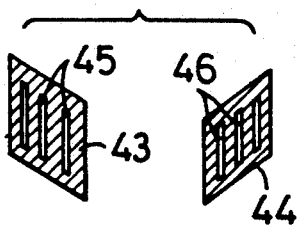
FIG. 27 is a schematic perspective view showing conductor plates used in the waveguide of FIG. 26.
Figure 28:
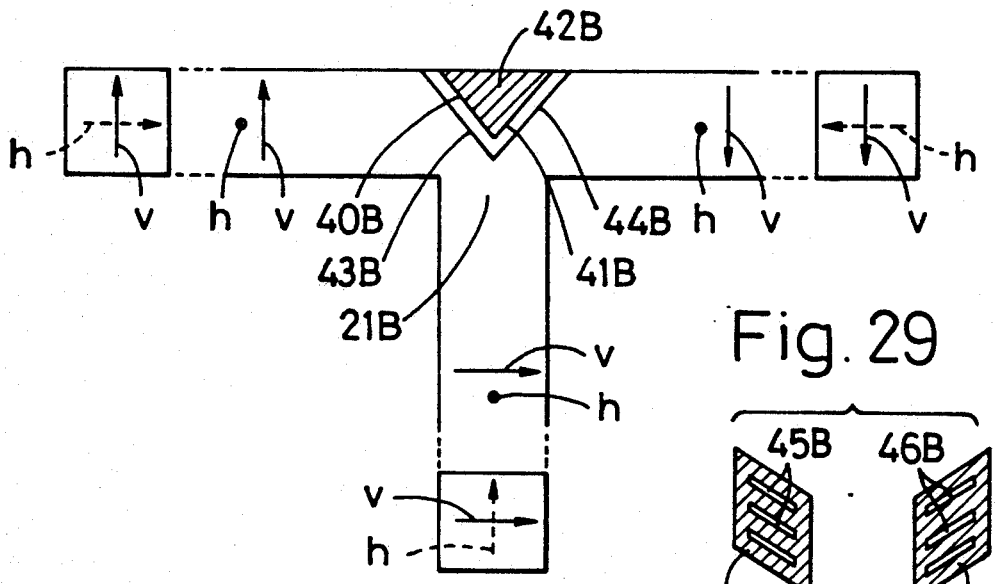
FIG. 28 is an explanatory view for a still another working example of the waveguide having a T-shaped branch to be employed in the antenna of FIG. 1.
Figure 29:
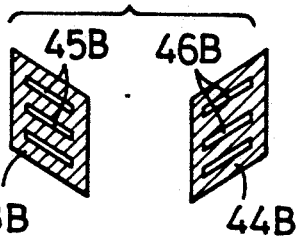
FIG. 29 is a schematic perspective view showing conductor plates used in the waveguide of FIG. 28.

According to another feature of the present invention, there is also taken a measure for restraining any difference to arise in the cutting rate between the horizontal and vertical polarized waves in converting their direction with the E-plane and H-plane at the T-shaped branch. Referring to FIGS. 26 and 27, the T-shaped branch 21A for propagating concurrently the horizontal polarized wave h and vertical polarized wave v mutually intersecting at right angles is provided, at connection point PA of both side waveguide parts of the branch, with a triangular column 42 having two slants 40 and 41 each made substantially at 45 degrees with respect to propagating direction of the electromagnetic waves, and conductor plates 43 and 44 are disposed in parallel with the slants 40 and 41. These conductor plates 43 and 44 are provided with slits 45 and 46 lying mutually in parallel and in a direction perpendicular to the electric field due to, for example, the horizontal polarized wave. With this arrangement, the horizontal polarized wave h of the electric field in the direction perpendicular to the slits 45 and 46 is made to pass through the conductor plates 43 and 44, while the vertical polarized wave v is to be subjected to the influence of the conductor plates 43 and 44 since the electric field of the wave is in the same direction as the slits 45 and 46. When the setting positions of the slants 40 and 41 and conductor plates 43 and 44 are made to be suitable for the propagation of the both horizontal and vertical polarized waves, therefore, it is possible to attain the excellent propagation characteristics for the both polarized waves. Depending on the inner diameter of the T-shaped branch and the inter-waveguide wave length of the electromagnetic wave, on the other hand, there arises an occasion where the vertical polarized wave v is reflected at the slope but the horizontal polarized wave h is reflected at the conductor plate, in respect of the propagation characteristics. In this case, as shown in FIGS. 28 and 29, a plurality of the slits 45B and 46B in the conductor plates 43B and 44B parallel to the slants 40B and 41B of the triangular column 42B at T-shaped branch of the connection waveguide 21B are made to extend perpendicular to the electric field of the vertical polarized wave v, and there can be attained the excellent propagation characteristics with respect to the both waves in similar manner to the foregoing.

Figure 30:
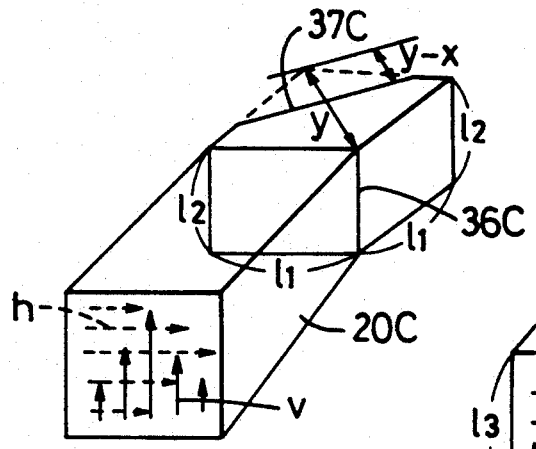
FIG. 30 is an explanatory view for a working example of the waveguide having a slant and employable in the antenna of FIG. 1.
Figure 32:
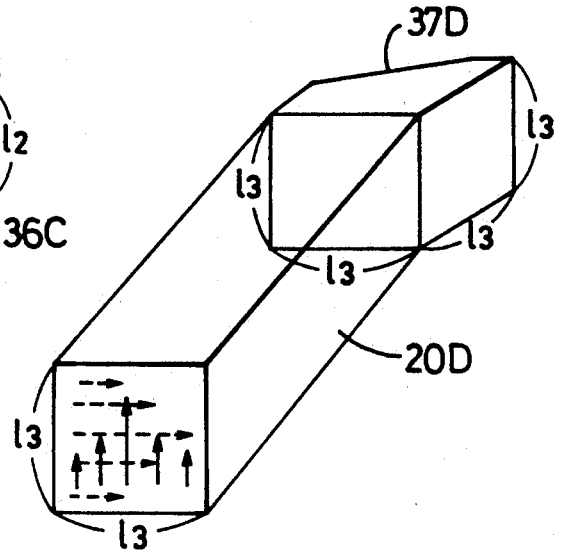
FIG. 32 is an explanatory view for another working aspect of the waveguide having a slant and employable in the antenna of FIG. 1.
Figure 31:
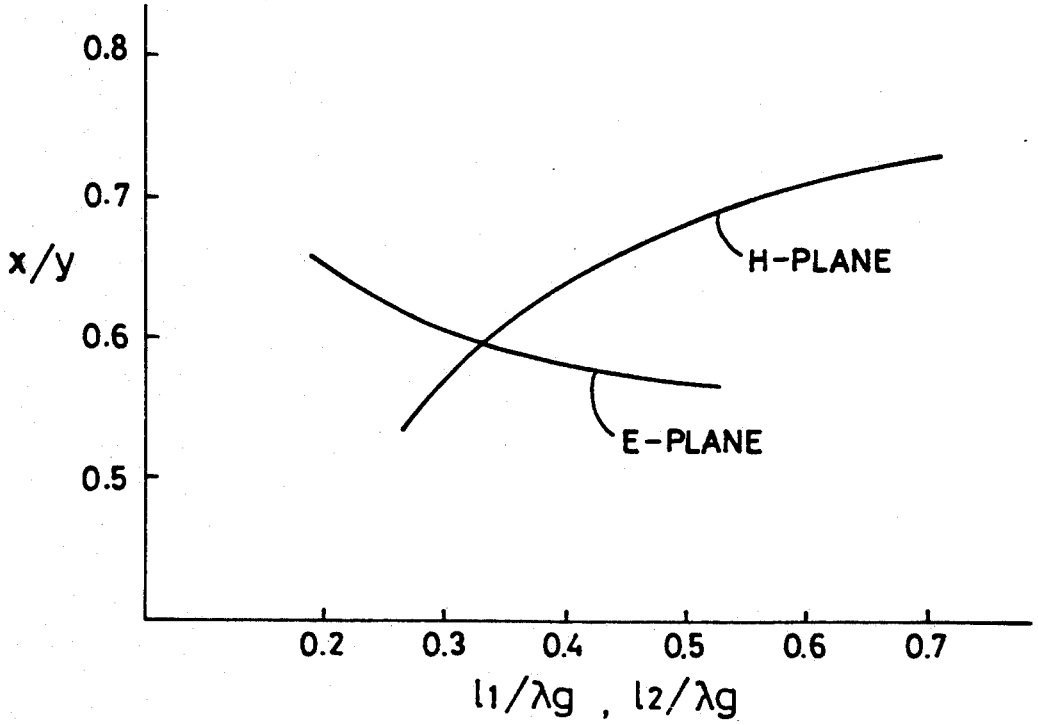
FIG. 31 is a diagram showing the relationship between the side length and the cutting rate in the waveguide of FIG. 30.

According to another feature of the present invention, further, there is provided an arrangement for realizing the directional conversion of the horizontal and vertical polarized waves without disposition of the conductor plate at the L-shaped bend of the waveguide. Referring to FIG. 30, the connection waveguide 20C substantially square in section at its upstream or input end is provided at the L-shaped branch with a slant 37C made substantially 45 degrees with respect to the propagating direction of the electromagnetic waves of the horizontal and vertical polarized waves h and v, and is tapered at opposing side walls so as to gradually converge from the square end to the bend 36C so that horizontal and vertical sides at the entrance of the bend 36C will be of different lengths l1 and l2 which are so set as to realize the directional conversion at an intersecting point between such E-plane curve and H-plane curve as shown in FIG. 31, whereby the horizontal and vertical polarized waves can be subjected to the directional conversion effectively at the optimum cutting rate (x/y as the ordinate of FIG. 31). As shown in FIG. 32, on the other hand, no tapered wall is formed from the upstream end to the bend but, in this case, the side length l3 of the connection waveguide 20D which is square from the end to the bend is so set as to have the directional conversion at the intersecting point between the E-plane and H-plane curves as shown in FIG. 31. In this case, too, both of the horizontal and vertical polarized waves can be simultaneously subjected to the directional conversion effectively at the optimum cutting rate.

Figure 33:
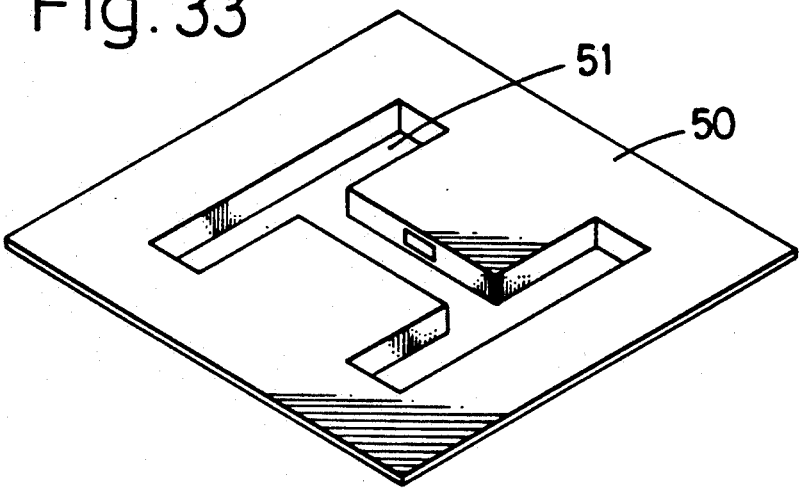
FIG. 33 shows in a perspective view still another working aspect of the waveguide employable in the antenna of FIG. 1.
Figure 34:
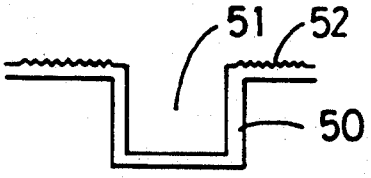
FIG. 34 is a fragmentary sectioned view of the waveguide in FIG. 33.
Figure 35:
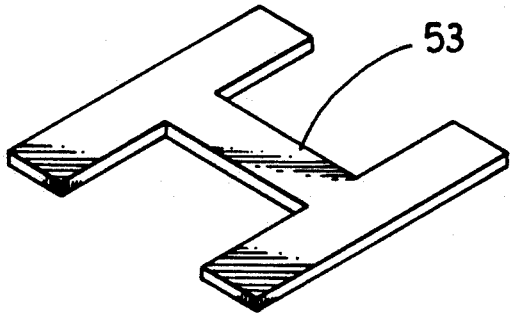
FIG. 35 shows in a perspective view a cover employed in the waveguide of FIG. 33.
Figure 36:
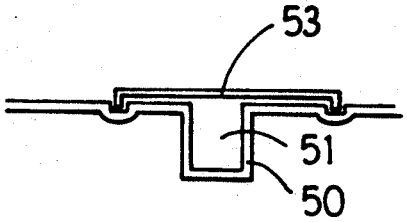
FIG. 36 shows in a schematic sectioned view a state in which the cover of FIG. 35 is fitted to the waveguide of FIG. 33.

According to still another feature of the present invention, there is provided an arrangement which allows the manufacturing of the waveguide feeding array antenna 10 to be simplified. That is, as shown in FIG. 33, an aluminum base 50 is formed by means of a die casting to have a recess 51 H-shaped in plan view, four of the antenna elements and associated basic waveguide members are employed, and the antenna having the waveguide network corresponding to its aspect of FIG. 7 is constituted. It is of course possible to form, upon the die casting, the recess in a pattern corresponding to the working aspect shown in FIG. 12. When the basic waveguide members of such die-cast aluminum plate is employed, on the other hand, it is preferable to provide an optimum surface 52 subjected to a surface treatment, as shown in FIG. 34, so that the loss at the waveguide can be reduced. Further, as occasion demands, a cover 53 made of a thin metal plate as shown in FIG. 35 is fitted over the recess 51 of FIG. 33, and the waveguide square shaped in section can be formed. In this case, it is desirable to provide a shallow recess peripherally about the recess 51, as shown in FIG. 36, for engagement therein of lower edge of the cover 53.

What is claimed is:

1. A waveguide feeding array antenna comprising:

a waveguide network including a plurality of waveguides which are substantially square in section and have end openings arranged in arrays, a plurality of antenna elements respectively assembled with each of the end openings, each antenna element simultaneously receiving both horizontal and vertical polarized waves and causing both of the horizontal and vertical polarized waves received to reflect towards and into the respective end openings, and means formed in and by the plurality of waveguides for in-phase combining and increasing power of the horizontal and vertical polarized waves respectively received at each of the end openings; and means, provided within said waveguide network, for feeding through the plurality of waveguides respective polarization components of the horizontal and vertical polarized waves independently of each other.

2. The antenna according to claim 1 wherein said waveguide network includes a means for converting dual linear waves into circularly polarized waves through a phase shift of 90 degrees.

3. The antenna according to claim 1 wherein said waveguide network includes a phase controlling means for controlling a polarization angle of components of the horizontal and vertical polarized waves.

4. The antenna according to claim 1 wherein each of the end openings are disposed on a plane which is perpendicular to a direction of beam-tilt for the antenna.

5. The antenna according to claim 1 wherein each of the plurality of antenna elements comprises:

a main reflector plate coupled to each of said end openings of the plurality of waveguides;

a plurality of subsidiary reflector plates, each having an opposing surface disposed opposing each of the respective end openings of the plurality of waveguides and slightly spaced therefrom;

wherein the main reflector plate is disposed for reflecting said horizontal and vertical polarized waves received once toward said opposing surface of said subsidiary reflector plate, and each of the opposing surfaces being disposed for reflecting the horizontal and vertical polarized wave reflected by the main reflector plate further toward each of the respective end openings of the plurality of waveguides; and a radome covering the whole of the plurality of antenna elements, each of the subsidiary reflector plates being provided on said radome.

6. A waveguide feeding array antenna comprising:

a waveguide network including a plurality of waveguides which are substantially square in section and have end openings arranged in arrays, a plurality of antenna elements respectively assembled with each of the end openings, each antenna element simultaneously receiving both horizontal and vertical polarized waves and causing both of the horizontal and vertical polarized waves received to reflect towards and into the respective end openings, and means for in-phase combining and increasing power of the horizontal and vertical polarized waves respectively received at each of the end openings including a plurality of connection waveguides, each of the respective plurality of connection waveguides having first and second ends, the first and the second ends being respectively coupled to one of the plurality of waveguides, first and second L-shaped bends respectively disposed adjacent to the first and the second ends, and a T-shaped branch waveguide, having a first end coupled substantially at a center point between two opposite ends, the two opposite ends being respectively coupled in a single plane with two of the plurality of connection waveguides at a coupling position, the coupling position being located a distance $\lambda g/2$ from the first and second L-shaped bends in each of the respective plurality of connection waveguides, where $\lambda g$ equals a inter-waveguide wave length; and means, provided within said waveguide network, for feeding through the plurality of waveguides respective polarization components of the horizontal and vertical polarized waves independently of each other.

7. The antenna according to claim 6 wherein each of the first and the second L-shaped bends of each of the respective plurality of connection waveguides includes an integral slant substantially at an angle of 45 degrees, and each of the plurality of connection waveguides having inner wall faces respectively tapered toward the first and second L-shaped bends.

8. A waveguide feeding array antenna comprising:

a waveguide network including, a plurality of waveguides which are substantially square in section and have end openings arranged in arrays, and a plurality of antenna elements, respectively assembled with each of the end openings, for simultaneously receiving both horizontal and vertical polarized waves, and for guiding the horizontal and vertical polarized waves received into the respective end openings, means for in-phase combining and increasing powers of the horizontal and vertical polarized waves respectively received at each of the end openings;

means, provided within said waveguide network, for feeding through the plurality of waveguides respective polarization components of the horizontal and vertical polarized waves independently of each other;

wherein said waveguide network further includes:

a plurality of connection waveguides, each of the respective plurality of connection waveguides having first and second ends, the first and the second ends being respectively coupled to one of the plurality of waveguides, first and second L-shaped bends respectively disposed adjacent to the first and the second ends;

a T-shaped branch waveguide, having a first end coupled substantially at a center point between two opposite ends, the two opposite ends being respectively coupled in a single plane with two of the plurality of connection waveguides at a coupling position, the coupling position being located a distance $\lambda g/2$ from the first and second L-shaped bends in each of the respective plurality of connection waveguides, where $\lambda g$ equals a inter-waveguide wave length; and wherein the first and the second L-shaped bends includes an integral slant substantially at an angle of 45 degrees, and a conductor plate having mutually parallel slits and disposed in a parallel to the integral slant, the mutually parallel slits of the conductor plate lying in a direction perpendicular to the electric field due to one of the horizontal and vertical polarized waves.

9. A waveguide feeding array antenna comprising:

a waveguide network including, a plurality of waveguides which are substantially square in section and have end openings arranged in arrays, and a plurality of antenna elements, respectively assembled with each of the end openings, for simultaneously receiving both horizontal and vertical polarized waves, and for guiding the horizontal and vertical polarized waves received into the respective end openings, means for in-phase combining and increasing powers of the horizontal and vertical polarized waves respectively received at each of the end openings;

means, provided within said waveguide network, for feeding through the plurality of waveguides respective polarization components of the horizontal and vertical polarized waves independently of each other;

wherein said waveguide network further includes:

a plurality of connection waveguides, each of the respective plurality of connection waveguides having first and second ends, the first and the second ends being respectively coupled to one of the plurality of waveguides, first and second L-shaped bends respectively disposed adjacent to the first and the second ends;

a T-shaped branch waveguide, having a first end coupled substantially at a center point between two opposite ends, the two opposite ends being respectively coupled in a single plane with two of the plurality of connection waveguides at a coupling position, the coupling position being located a distance $\lambda g/2$ from the first and second L-shaped bends in each of the respective plurality of connection waveguides, where $\lambda g$ equals a inter-waveguide wave length; and wherein the T-shaped branch waveguide includes a triangular column, at said coupling position, having two slants each of which is at an angle of 45 degrees with respect to electromagnetic wave due to the horizontal and vertical polarized waves, and with two conductor plates respectively disposed in parallel to each of said slants and having mutually parallel slits lying in a direction perpendicular to an electric field due to one of the horizontal and vertical polarized waves.

10. A waveguide feeding array antenna comprising:

a waveguide network including a plurality of waveguides which are substantially square in section and have end openings arranged in arrays, a plurality of antenna elements respectively assembled with each of the end openings for simultaneously receiving both horizontal and vertical polarized waves, and for guiding the horizontal and vertical polarized waves received into the respective end openings, and means for in-phase combining and increasing power of the horizontal and vertical polarized waves respectively received at each of the end openings; and means provided within said waveguide network for feeding through the plurality of waveguides respective polarization components of the horizontal and vertical polarized waves independently of each other;

wherein each of said antenna elements comprising a slot patch disposed adjacent to each of the end openings.

11. A waveguide feeding array antenna comprising:

a waveguide network including a plurality of waveguides which are substantially square in section and have end openings arranged in arrays, a plurality of antenna elements respectively assembled with each of the end openings for simultaneously receiving both horizontal and vertical polarized waves, and for guiding the horizontal and vertical polarized waves received into the respective end openings, and means for in-phase combining and increasing powers of the horizontal and vertical polarized waves respectively received at each of the end openings; and means provided within said waveguide network for feeding through the plurality of waveguides respective polarization components of the horizontal and vertical polarized waves independently of each other; wherein:

each of the plurality of antenna elements comprises a main reflector plate coupled to each of said end openings of the plurality of waveguides, a subsidiary reflector plate slightly spaced from the end openings of the waveguides; and a radome covering the whole of the plurality of antenna elements, each of the subsidiary reflector plates being provided on the radome.

12. The antenna according to claim 11 wherein said plurality of antenna elements are entirely arranged in a flat box.

13. The antenna according to claim 12 wherein the main reflector plate of each of the plurality of antenna elements being formed in a flat box opened on a front face, and the subsidiary reflector plate being formed in a flat plate.

14. The antenna according to claim 12 wherein the main reflector plate of each of the plurality of antenna elements being formed in a flat box opened on its front face, and the subsidiary reflector plate being formed to have a conical face expanding toward the opening.

15. The antenna according to claim 12 wherein the main reflector plate and the subsidiary reflector plate being a hemispherical shape.

16. A waveguide feeding array antenna comprising:

a waveguide network including, a plurality of waveguides which are substantially square in section and have end openings arranged in arrays, and a plurality of antenna elements, respectively assembled with each of the end openings, for simultaneously receiving both horizontal and vertical polarized waves, and for guiding the horizontal and vertical polarized waves received into the respective end openings, means for in-phase combining and increasing powers of the horizontal and vertical polarized waves respectively received at each of the end openings;

means, provided within said waveguide network, for feeding through the plurality of waveguides respective polarization components of the horizontal and vertical polarized waves independently of each other; and wherein said waveguide network further includes:

a shunt waveguide respectively coupled to at least one of the plurality of waveguides adjacent to the end opening, and a polarization filter provided in at least one of the plurality of waveguides adjacent to the position where the shunt waveguide is coupled, and the polarization filter having mutually parallel slits lying in a direction perpendicular to the electric field due to one of the horizontal and vertical polarized waves.

17. A waveguide feeding-array antenna comprising:

a waveguide network including, a plurality of waveguides which are substantially square in section and have end openings arranged in arrays, a plurality of antenna elements respectively assembled with each of the end openings for simultaneously receiving both horizontal and vertical polarized waves, and for guiding the horizontal and vertical polarized waves received into the respective end openings, and means for in-phase combining and increasing powers of the horizontal and vertical polarized waves respectively received at each of the end openings; and means provided within said waveguide network, for feeding through the plurality of waveguides respective polarization components of the horizontal and vertical polarized waves independently of each other;

wherein said waveguide network further includes a phase controlling means for controlling a polarization angle of components of the horizontal and vertical polarized waves, and said phase controlling means dynamically controls said polarization angle of components of the horizontal and vertical polarized waves.

18. A waveguide feeding array antenna comprising:

a waveguide network including, a plurality of waveguides which are substantially square in section and have end openings arranged in arrays, and a plurality of antenna elements, respectively assembled with each of the end openings, for simultaneously receiving both horizontal and vertical polarized waves, and for guiding the horizontal and vertical polarized waves received into the respective end openings, including a main reflector plate coupled to each of the plurality of waveguides, the main reflector plate having an opening, a subsidiary reflector plate slightly spaced from the opening; and a radome covering the whole of the plurality of antenna elements, each of the subsidiary reflector plates being provided on the radome.

19. A waveguide feeding array antenna comprising:

a waveguide network including a plurality of waveguides which are substantially square in section and have end openings arranged in arrays, a plurality of antenna elements respectively assembled with each of the end openings, for simultaneously receiving both horizontal and vertical polarized waves, and for guiding the horizontal and vertical polarized waves received into the respective end openings, and a waveguide connection network for in-phase combining and increasing powers of the horizontal and vertical polarized waves respectively received at each of the end openings; and means, provided within said waveguide network, for feeding through the plurality of waveguides respective polarization components of the horizontal and vertical polarized waves independently of each other.

* * * * *

UNITED STATES PATENT AND TRADEMARK OFFICE

CERTIFICATE OF CORRECTION

PATENT NO. :5,243,357
DATED :September 7, 1993
INVENTOR(S) :Koike, et. al.

It is certified that error appears in the above-indentified patent and that said Letters Patent is hereby corrected as shown below:

Claim 8, column 12, line 44, delete "a".
Claim 11, column 13, lines 65-66, change "powers" to --power--.
Claim 17, column 15, line 9, delete ",".
Claim 19, column 16, line 23, change "powers" to --power--.

Signed and Sealed this

Fifth Day of April, 1994

Bruce Lehman

*Attest:*

BRUCE LEHMAN

*Attesting Officer*

*Commissioner of Patents and Trademarks*